United States Patent [19]

Gemmill et al.

[11] 4,374,032

[45] Feb. 15, 1983

[54] LUBRICANT COMPOSITION CONTAINING BORATED OXAZOLINE FRICTION REDUCER

[75] Inventors: Robert M. Gemmill, Pitman; Andrew G. Horodysky, Cherry Hill, both of N.J.

[73] Assignee: Mobil Oil Corporation, New York, N.Y.

[21] Appl. No.: 134,849

[22] Filed: Mar. 28, 1980

[51] Int. Cl.[3] ..... C10M 1/54

[52] U.S. Cl. ..... 252/49.6

[58] Field of Search ..... 252/49.6

[56] References Cited

U.S. PATENT DOCUMENTS

| | | | |
|---|---|---|---|
| 2,905,644 | 9/1959 | Butter | 252/51.5 R |
| 3,009,791 | 11/1961 | Emrick | 252/49.6 X |
| 3,012,968 | 12/1961 | Emrick et al. | 252/49.6 |
| 3,446,808 | 5/1969 | Cyba | 252/49.6 X |
| 4,071,548 | 1/1978 | Okamoto | 252/49.6 X |
| 4,097,389 | 6/1978 | Andress, Jr. | 252/49.6 X |
| 4,116,876 | 9/1978 | Brois et al. | 252/49.6 |
| 4,162,224 | 7/1979 | Bridger | 252/49.6 |

FOREIGN PATENT DOCUMENTS

| | | | |
|---|---|---|---|
| 7509290 | 8/1975 | Netherlands | 252/49.6 |

*Primary Examiner*—Andrew Metz

*Attorney, Agent, or Firm*—Charles A. Huggett; Michael G. Gilman; Claude E. Setliff

[57] ABSTRACT

Boration of an oxazoline of the formula

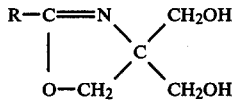

where R is defined hereinbelow provides a new composition of matter which, when added to a lubricating oil, will reduce friction and decrease fuel consumption in an internal combustion engine.

7 Claims, No Drawings

LUBRICANT COMPOSITION CONTAINING BORATED OXAZOLINE FRICTION REDUCER

BACKGROUND OF THE INVENTION

1. Field of the Invention

The invention is concerned with a lubricant composition. More particularly, it is concerned with a lubricant composition containing a friction reducing additive which when in a lubricating oil composition reduces friction in an internal combustion engine and thereby decreases the fuel consumption thereof.

2. Discussion of the Prior Art

The synthesis of hydrocarbyl oxazolines from the appropriate carboxylic acid and 2-amino-2-(hydroxymethyl)-1,3-propanediol is known. However, no art is known that teaches or suggests the use of the herein disclosed derivatives as friction reducing additives in automotive engine oils.

Over the years numerous efforts have been made to reduce the amount of fuel consumed by automobile engines and other lubricated devices. Many such efforts have been directed at mechanical means, as for example, setting the engine for a leaner burn or simply building smaller cars and smaller engines.

Other efforts have revolved around finding lubricants that reduce the overall friction in the engine and/or the power train components, thus allowing a reduction in energy requirements thereto. Much work has been done with mineral lubricating oils and greases, modifying them with additives to enhance their friction properties. On the other hand, new lubricants have been synthesized and compounded for use in modern engines. Many of these are lower viscosity fluids which result in a reduction of friction. With respect to some present synthetic lubricant formulations, it is the physical properties of the oil itself, such as viscosity characteristics, that provide improved lubrication and reduced fuel consumption, not the additives therein.

SUMMARY OF THE INVENTION

The invention provides a lubricant composition comprising a major proportion of a lubricant and a friction reducing amount of a borated di(hydroxymethyl) hydrocarbyl oxazoline. The invention also provides a method of reducing fuel consumption of an internal combustion engine by lubricating the moving parts thereof with a lubricating oil containing said oxazoline borate. the hydrocarbyl group has 9 to 49 carbon atoms and includes alkyl, alkenyl, aryl, aralkyl and alkaryl, wherein the aryl portion contains 6 to 14 carbon atoms.

DESCRIPTION OF SPECIFIC EMBODIMENTS

It has been estimated that if all the fuel burned in an automobile weighing about 4000 pounds and having a 10:1 compression ratio were used to propel the automobile, it could travel between 125 and 130 miles on a gallon of gasoline. This assumes a speed of around 40 mph.

The losses due to fuel pumping, tare, friction, and the like reduce the energy available for propelling the car to about 13.1%.

Of this loss, approximately 5%, or 6.4 mpg, can be accounted for by losses due to lubricated engine components. Consequently, a mere 10% decrease in boundary and viscous friction would lead to a 3.8% increase in fuel economy (from 16.7 mpg to 17.3 mpg). It is little wonder, then, that energy companies are concerned with finding new lubricants or new additives that have superior lubricity properties.

As was mentioned hereinabove, one method of boosting fuel economy is to optimize the lubrication of the engine and drive train; that is, minimize friction losses between lubricated moving parts. The benefit using certain synthetic lubricating oils over high grade mineral lubricating oils can be better than 4%, attained solely by lowering of the viscous friction of the engine lubricant. Additional improvements may be realized by modifications of the boundary friction of the lubricant.

Broadly, the products useful in this invention can be made by methods well known in the prior art. For example, they are made under appropriate conditions by reacting a hydrocarbyl carboxylic acid with 2-amino-2-(hydroxymethyl)-1,3-propanediol, also called tris(hydroxymethyl)aminomethane, to obtain the oxazoline derivative, followed by reaction of the derivative with a boron compound, such as boric acid.

The reaction to form the boron compounds of this invention is a complex one. Thus, the product produced is, also complex. Although we are not sure what the total make up of the product is, we believe it has at least a substantial amount of a product of the structure

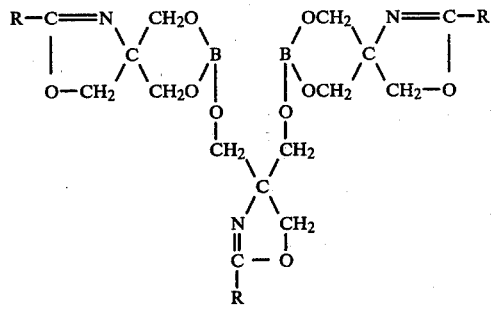

as well as other similar oligomers.

The above-shown product may be contained in a product made by reacting one mole of a carboxylic acid with one mole of tris(hydroxymethyl)aminomethane, followed by reaction of 3 moles of this product with two moles of boric acid. In addition to the boric acid, other boron compounds can be used. These include alkyl borates of the formula $$(R'O)_xB(OH)_y$$

wherein R' is a $C_1$–$C_6$ alkyl group, x is 1 to 3 and y is 0 to 2. When these are used, the final product is believed to be the same, one possible product being as illustrated above. One borate that can be named is tributyl borate.

More particularly, the product can be made by reacting a carboxylic acid of the formula

R—COOH wherein R is a $C_9$ to $C_{49}$ hydrocarbyl group, with tris(hydroxymethyl)aminomethane such that the oxazoline formed has the formula

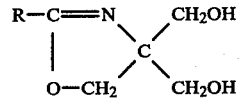

wherein R is as hereindefined, followed by reacting the oxazoline with boric acid or a borate of the formula $$(R'O)_xB(OH)_y$$

wherein R', x and y are as defined hereinabove. Boration can be partial or complete, but for maximum effect, higher levels of borate are generally preferred.

The carboxylic acid, as indicated, may have from 10 to 50 carbon atoms, including the carboxyl carbon atom. These include the saturated decanoic, dodecanoic, tetradecanoic, octadecanoic, eicosanoic acids and the like, as well as the unsaturated acids, including particularly oleic acid.

The first reaction, i.e. between the monocarboxylic acid and the amine, can be carried out at from about 80° C. to about 250° C., preferably from about 120° C. to about 190° C. The temperature chosen will depend for the most part on the reactants chosen and whether or not a solvent is used. In carrying out this reaction, it is essential that quantities of reactants be chosen such that two hydroxyls remain for the reaction with the boron compound. For example, in the reaction illustrated, one mole of the acid and one mole of the amine are required. A slight excess of amine may be used if desired, but an excess of acid in this case would lead to the formation of some monoester oxazoline, in addition to the preferred oxazoline.

In carrying out the reaction to form the boron product, up to stoichiometric amounts of the oxazoline and boron compound may be used. That is to say, boration can be partial or complete. The temperature of this reaction can be from about 50° C. to about 300° C., preferably from about 70° C. to about 230° C.

While atmospheric pressure is generally preferred, the reaction with the boron compound can be advantageously run at from about 0.3 to about 2 atmospheres. Furthermore, a solvent is desirable. In general, any polar or non-polar solvent can be used including toluene, xylene, 1,4-dioxane or more polar reactive solvents, such as butanol-1 and pentanol, and the like.

The times for the reactions are not critical. Thus, any phase of the process can be carried out in from 1 to 48 hours.

The additive may be used effectively to impart to organic media, particularly to greases and lubricating oils, the properties mentioned hereinabove. An effective amount of the additive compound will range from about 0.1% to about 10% by weight. Preferably the organic medium or substrate, e.g., oil of lubricating viscosity or grease therefrom, contains from about 1.0% to 5.0% of the additive and more preferably from about 2.0% to about 4.0% by weight thereof, based on the total weight of the lubricant composition.

Of particular significance, in accordance with the present invention, is the ability to improve the properties of oleaginous materials such as lubricating media which may comprise liquid oils, in the form of either a mineral oil or a synthetic oil, or in the form of a grease in which any of the aforementioned oils are employed as a vehicle. In general, mineral oils, both paraffinic, naphthenic and mixtures thereof, employed as the lubricant, or grease vehicle, may be of any suitable lubricating viscosity range, as for example, from about 45 SUS at 100° F. to about 6000 SUS at 100° F., and preferably, from about 50 to about 250 SUS at 210° F. These oils may have viscosity indexes ranging to about 100 or higher. Viscosity indexes from about 70 to about 95 are preferred. The average molecular weights of these oils may range from about 250 to about 800. Where the lubricant is to be employed in the form of a grease, the lubricating oil is generally employed in an amount sufficient to balance the total grease composition, after accounting for the desired quantity of the thickening agent and other additive components to be included in the grease formulation. A wide variety of materials may be employed as thickening or gelling agents. These may include any of the conventional metal salts or soaps, which are dispersed in the lubricating vehicle in grease-forming quantities in such degree as to impart to the resulting grease composition the desired consistency. Other thickening agents that may be employed in the grease formulation may comprise the non-soap thickeners, such as surface-modified clays and silicas, aryl ureas, calcium complexes and similar materials. In general, grease thickeners may be employed which do not melt and dissolve when used at the required temperature within a particular environment; however, in all other respects, any material which is normally employed for thickening or gelling hydrocarbon fluids for forming grease can be used in preparing the aforementioned improved grease in accordance with the present invention.

In instances where synthetic oils, or synthetic oils employed as the vehicle for the grease, are desired in preference to mineral oils, or in combination therewith, various compounds of this type may be successfully utilized. These synthetic oils may be used alone, in combination with mineral oils, or with each other as a lubricating oil. Typical synthetic vehicles include synthetic hydrocarbons such as polyisobutylene, polybutenes, hydrogenated polydecenes, the polyglycols, including polypropylene glycol, polyethylene glycol, synthetic ester oils illustrated by trimethlolpropane esters, neopentyl alcohol and pentaerythritol esters, di(2-ethylhexyl) sebacate, di(2-ethylhexyl)adipate, dibutyl phthalate and other types, as for example, fluorocarbons, esters of phosphorus-containing acids, liquid ureas, ferrocene derivatives, hydrogenated synthetic oils, chain-type polyphenols, siloxanes and silicones (polysiloxanes), alkyl-substituted diphenyl esters typified by a butylsubstituted bis(p-phenoxyphenyl) ether and phenoxyphenyl ether.

Having described the invention broadly, the following are offered as specific illustrations. They are illustrations only, and the invention is not limited thereby.

EXAMPLE 1

Borated Di(hydroxymethyl) Oleyl Oxazoline

A one liter glass reactor fitted with a nitrogen inlet, stirrer, thermometer, Dean-Stark water trap and condenser was used for the reaction.

Oleic acid (1.0 mole, 282.4 grams), 2-amino-2-(hydroxymethyl)-1,3-propanediol (1.0 mole, 121.1 grams) and 100 ml. of toluene were charged to the reactor.

The reaction mixture was heated, using a nitrogen purge and rapid stirring, to a maximum temperature of 180° C. for 5 hours. Water evolved over the temperature range of 125°–180° C. A total of 36 ml. of water (theory, 36 ml.) was collected. The product was di(hydroxymethyl) oleyl oxazoline. This compound, when isolated, is a white, waxy, oil insoluble material.

The second step involved the addition of boric acid (0.667 mole, 41.3 grams) to the above reaction mixture. The total reaction mixture was heated, using a nitrogen purge and rapid stirring, to a maximum temperature of 215° C. for a period of 17 hours. A total of 35.5 ml. of water (theory, 36 ml.) was collected. The product was a borate ester composition of di(hydroxymethyl) oleyl oxazoline. The toluene was removed by vacuum distillation and the product vacuum filtered through a diatomaceous clay filter aid. The final product was a clear, amber colored, viscous fluid.

EXAMPLE 2

Borated Di(hydroxymethyl) Oleyl Oxazoline

A one liter glass reactor fitted with a nitrogen inlet, stirrer, thermometer, Dean-Stark water trap and condenser was used for the reaction.

Oleic acid (1.0 mole, 282.0 grams), 2-amino-2-(hydroxymethyl)-1,3-propanediol (1.0 mole, 121.1 grams) and 100 ml. of toluene were charged to the reactor.

The reaction mixture was heated, using a nitrogen purge and rapid stirring, to a maximum temperature of 162° C. for 8 hours. Water evolved over the temperature range of 120°–162° C. A total of 36 ml. of water (theory, 36 ml.) was collected. The product was di(hydroxymethyl) oleyl oxazoline. This compound, when isolated, is a white, waxy, oil-insoluble material.

The second step involved the addition of boric acid (0.667 mole, 41.3 grams) and 1-butanol (0.066 mole, 4.9 grams) to the above reaction mixture. The total reaction mixture was heated, using a nitrogen purge and rapid stirring, to a maximum temperature of 160° C. for a period of 9 hours. A total of 34 ml. of water (theory, 36 ml.) was collected. The product was a borate ester composition of di(hydroxymethyl) oleyl oxazoline. The toluene was removed by vacuum distillation and the product vacuum filtered through a diatomaceous clay. The final product was a clear, amber colored, viscous fluid.

EXAMPLE 3

Borated Di(hydroxymethyl) Oleyl Oxazoline

A 12 liter glass reactor fitted with a nitrogen inlet, stirrer, thermometer, Dean-Stark water trap and condenser was used for the reaction.

Oleic acid (10.0 moles, 2824.5 grams), 2-amino-2-(hydroxymethyl)-1,3-propanediol (10.0 moles, 1211.4 grams) and 500 ml. of toluene were charged to the reactor.

The reaction mixture was heated, using a nitrogen purge and rapid stirring, to a maximum temperature of 179° C. for 17 hours. Water evolved over the temperature range of 120°–179° C. A total of 367 ml. of water (theory, 360 ml.) was collected. The product was di(hydroxymethyl) oleyl oxazoline.

The second step involved the addition of boric acid (6.67 moles, 412.2 grams) and 1-butanol (2.70 moles, 200.0 grams) to the above reaction mixture. The total reaction mixture was heated, using a nitrogen purge and rapid stirring, to a maximum temperature of 192° C. for a period of 36 hours. A total of approximately 352 ml. of water (theory, 360 ml.) was collected. The product was a borate ester composition of di(hydroxymethyl) oleyl oxazoline possibly containing some butyl borate entity. The toluene and 1-butanol were removed by vacuum distillation and the product vacuum filtered through a diatomaceous clay. The final product was a clear, amber colored, viscous fluid.

The borated di(hydroxymethyl) oleyl oxazoline was evaluated at 2 and 4 wt. % concentration in a fully formulated, 5W-20 synthetic automotive engine oil having the following general characteristics KV@ 100° C.-6.8 cs
KV@ 40° C.-36.9 cs
VI-143

Results refer to percent reduction in coefficient of friction as compared to the unmodified oil.

Description

The Low Velocity Friction Apparatus (LVFA) is used to measure the coefficient of friction of test lubricants under various loads, temperatures, and sliding speeds. The LVFA consists of a flat SAE 1020 steel surface (diam. 1.5 in.) which is attached to a drive shaft and rotated over a stationary, raised, narrow ringed SAE 1020 steel surface (area 0.08 in.2). Both surfaces are submerged in the test lubricant. Friction between the steel surfaces is measured as a function of the sliding speed at a lubricant temperature of 250° F. The friction between the rubbing surfaces is measured using a torque arm-strain gauge system. The strain gauge output, which is calibrated to be equal to the coefficient of friction, is fed to the Y axis of an X-Y plotter. The speed signal from the tachometer-generator is fed to the X-axis. To minimize external friction, the piston is supported by an air bearing. The normal force loading the rubbing surfaces is regulated by air pressure on the bottom of the piston. The drive system consists of an infinitely variable-speed hydraulic transmission driven by a ½ HP electric motor. To vary the sliding speed, the output speed of the transmission is regulated by a lever-cam-motor arrangement.

Procedure

The rubbing surfaces and 12–13 ml of test lubricants are placed on the LVFA. A 240 psi load is applied, and the sliding speed it maintained at 40 fpm at ambient temperature for a few minutes. A plot of coefficients of friction (Uk) over the range of sliding speeds, 5 to 40 fpm (25–195 rpm), is obtained. A minimum of three measurements is obtained for each test lubricant. Then, the test lubricant and specimens are heated to 250° F., another set of measurements is obtained, and the system is run for 50 min. at 250° F., 240 psi, and 40 fpm sliding speed. Afterward, measurements of Uk vs speed were taken at 240, 300, 400 and 500 psi. Freshly polished steel specimens are used for each run. The surface of the steel is parallel ground to 4 to 8 microinches. The results in Table 1 were at 250° F. and 500 psi.

The borated oxazoline esters were evaluated at 2%. and 4% concentration by weight of lubricating oil in a fully formulated 5W-20 synthetic lubricating oil comprising an additive package including antioxidant; detergent and dispersant. The data in Table 1 are reported as percent reduction in coefficient of friction at two speeds.

TABLE 1

FRICTION REDUCTION EVALUATIONS

| | Additive Concentration | Friction Reduction, % at Sliding speeds | |
|---|---|---|---|
| | Wt. % | 5 Ft./min | 30 Ft./min |
| Test Oil | 0 | 0 | 0 |
| Test Oil plus borated oxazoline made in Example 1 | 4 | 40 | 25 |
| Test Oil plus borated oxazoline made in Example 2 | 4 | 42 | 31 |
| Test Oil plus borated oxazoline made | 2 | 29 | 25 |

TABLE 1-continued

| FRICTION REDUCTION EVALUATIONS | | | |
|---|---|---|---|
| | Additive Concentration | Friction Reduction, % at Sliding speeds | |
| | Wt. % | 5 Ft./min | 30 Ft./min |
| in Example 3 | 4 | 47 | 34 |

We claim:

1. A lubricant composition comprising a major proporation of an oil of lubricating viscosity or a grease therefrom and a friction-reducing amount of the compound prepared by reacting tris(hydroxymethyl-)aminomethane with a carboxylic acid of the formula:

R—COOH wherein R is a $C_9$ to $C_{49}$ hydrocarbyl group, the reaction being carried out at from about 80° C. to about 250° C., the final temperature being sufficiently high to form an intermediate of the formula:

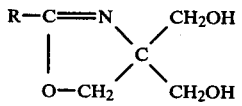

followed by reacting said intermediate, at from about 50° C. to about 300° C., with a boron-containing compound selected from the group consisting of boric acid and a borate of the formula:

$(R'O)_xB(OH)_y$ wherein R′ is a $C_1$ to $C_6$ alkyl, x is 1 to 3 and y is 0 to 2.

2. A composition of claim 1 wherein in preparing said compound the acid is oleic acid.

3. A composition of claim 1 wherein in preparing said compound the boron-containing compound used is boric acid.

4. A composition of claim 1 wherein in preparing said compound the acid is oleic acid and the boron-containing compound is boric acid.

5. A composition of claim 1 wherein the lubricant is a lubricating oil.

6. A composition of claim 5 wherein the lubricating oil is a synthetic lubricating oil.

7. A method of reducing fuel consumption in an internal combustion engine comprising lubricating said engine with a lubricating oil composition comprising a major proportion of a lubricating oil and a fuel consumption reducing amount of the compound prepared by reacting tris(hydroxymethyl)aminomethane with a carboxylic acid of the formula:

R—COOH wherein R is a $C_9$ to $C_{49}$ hydrocarbyl group, the reaction being carried out at from about 80° C. to about 250° C., the final temperature being sufficiently high to form an intermediate of the formula:

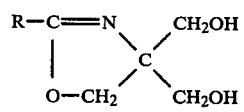

followed by reacting said intermediate, at from about 50° C. to about 300° C., with a boron-containing compound selected from the group consisting of boric acid and a borate of the formula:

$(R'O)_xB(OH)_y$ wherein R′ is a $C_1$ to $C_6$ alkyl, x is 1 to 3 and y is 0 to 2.

* * * * *